United States Patent [19]

Shine et al.

[11] 3,939,623

[45] Feb. 24, 1976

[54] PLASMA COLLECTION SYSTEM

[75] Inventors: Dennis F. Shine, Huntington Beach, Calif.; Gunther W. Torau, Buffalo Grove, Ill.

[73] Assignee: Baxter Laboratories, Inc., Deerfield, Ill.

[22] Filed: May 22, 1975

[21] Appl. No.: 579,768

Related U.S. Application Data

[63] Continuation of Ser. No. 427,197, Dec. 21, 1973, abandoned.

[52] U.S. Cl. ..... 53/25; 53/37; 214/305

[51] Int. Cl.[2] ..... B65B 3/04

[58] Field of Search ..... 53/25, 22 R, 22 B, 37, 53/88; 214/305

[56] References Cited

UNITED STATES PATENTS

| | | | |
|---|---|---|---|
| 2,787,875 | 4/1957 | Johnson | 53/88 X |
| 2,829,788 | 4/1958 | Giordano | 214/305 |
| 2,949,712 | 8/1960 | Bieberdorf et al. | 53/37 X |
| 3,382,642 | 5/1968 | Shaw | 53/22 B |

*Primary Examiner*—Travis S. McGehee

*Attorney, Agent, or Firm*—Lawrence W. Flynn; Louis Altman

[57] ABSTRACT

There is disclosed herein a method for collecting blood plasma in plastic bottles wherein the blood plasma can be stored for periods of time and can then be utilized in obtaining blood fractions therefrom. The method includes the concept of filling a previously sterilized and hermetically sealed bottle with blood plasma. The bottle, after filling, is sealed at the neck portion thereof by means of heat sealing. The portion of the bottle above the heat seal is severed. Thereafter, the filled bottle is frozen and transported to the site for use. The bottle containing the plasma is then thawed and conveyed to a plasma removing device. The plasma is removed by severing a portion of the bottom of the plastic bottle, thereby permitting the liquefied plasma to flow therefrom into a collection vat. The bottle in which the plasma is collected and stored has a unique configuration in that it is a blow-molded bottle having a cap thereon which is produced integrally with the bottle so that it is always in a sterile condition. In one embodiment, the cap is broken from the top of the bottle, thereby exposing a mouth having a threaded configuration thereabout so that a cap may be screwed thereon. The cap has means for venting and for introduction of a probe through which the plasma is conveyed into the bottle. In another embodiment, the top of the bottle terminates in a membrane suitable for piercing with a probe and a venting arrangement is included, whereby the plasma can be charged into the plastic bottle. Below the mouth, there is a flattened neck portion providing an area at which a heat sealing means can be applied to further compress into abutment the neck and to heat seal same in that condition. The upper portion of the mouth carrying member can be severed from the bottle.

3 Claims, 22 Drawing Figures

PLASMA COLLECTION SYSTEM

This is a continuation of application Ser. No. 427,197, filed Dec. 21, 1973, now abandoned.

BACKGROUND OF THE INVENTION

Much progress has been made in the handling of plasma and whole blood obtained from human donors. Especially, considerable activity has been generated with respect to the collection of plasma which has a considerably longer shelf life than whole blood. Whole blood is collected by conventional means well known in the art. The plasma is removed from the whole blood by centrifugation, again, by employing conventional devices. As an aside, new concepts include the removal of the cells from plasma through centrifugation and the reintroduction of the cells to the donor, thereby permitting the donor to recoup a good portion of that which has been donated. In that way the donor may give blood on more occasions than would heretofore be possible.

The need for the reintroduction of blood cells to the donor has become extremely important in view of the paucity of blood that is available. Secondly, there has been a considerable increase in the need for plasma in view of the beneficial fractions that may be obtained therefrom through various sophisticated processes. Blood plasma is collected at many areas throughout the world for use in central laboratories that may be located quite remote from the site of collection. Consequently, the plasma, having an already long shelf life, is further enhanced in being able to be frozen. The plasma is shipped in the frozen state to the laboratory at which the plasma is thawed and fractionated by well known methods such as described, for example, in U.S. Pat. Nos. 3,560,475; 3,631,018; 3,682,881; and 3,763,135.

In order to provide sterility at the collection point and to retain the plasma in separated noncommingled condition, it is desirable to collect the plasma in separate bottles containing approximately 1 quart of plasma and to freeze the plasma in such bottles until they are thawed. The bottles are then opened and the plasma is dumped into a single collection vat. Ordinary use of bottles provides unsterile conditions at the site of collection. In many instances, blood is collected in an open system in which the liklihood of bacterial contamination exists throughout the bottle and it therefore is necessary to autoclave or gas sterilize the entire bottle and its contents. In other cases, the bottles merely have a cap which has been screwed on to the mouth of the bottle and the bottles then must be opened prior to filling. It has been found on occasion that bacteria may be harbored on the thread of the bottle or under the underside of the cap. In order to avoid such contamination, the mouth of the bottle must be sterilized prior to use.

The U.S. government has promulgated regulations that require plasma collection bottles to be in a sterile condition, even though the plasma subsequently will be treated in a manner that will certainly insure sterility. Accordingly, the plasma collection bottle included in the present concept is blow-molded with an integrally formed cap under sterilizing conditions.

SUMMARY OF THE INVENTION

The present invention provides an ingenious plasma collection system and a bottle for use in connection therewith. The bottle is manufactured by blow-molding techniques from thermoplastic resins suitable for blow-molding such as the polyolefin resins, for example, polyethylene or polypropylene, and other materials which are compatible with plasma. U.S. Pat. Nos. 3,597,793; 3,730,372; and U.S. Pat. No. Re. 27,155; and British Pat. No. 1,318,030 illustrate blow-molding apparatus which can be adapted for blow-molding and heat sealing the bottle. Said patents are incorporated herein by reference. The bottle has an essentially cylindrical configuration with a neck portion that is not cylindrical but has been flattened to a considerable degree. Above the neck is what can be termed a mouth portion which in one embodiment has a pierceable membrane. In another embodiment the mouth portion has a threaded area and a breakaway cap positioned thereon.

In both embodiments, the thermoplastic bottle is sterile blow-molded and hermetically sealed in a single operation whereby there is no contamination of the inside of the bottle due to the conditions employed during the blow-molding and heat sealing of the bottle. These conditions include the high temperature of the resin during molding; steam sterilization of the blow lines; use of filtered air or sterilizing gas during blow-molding; and provision of a bottle configuration adapted to heat sealing after filling with plasma. The bottle so formed can then be transported to the situs of a blood collection room anywhere in the world. In one embodiment the cap is broken away from the mouth and a second cap is attached thereto which has been previously packaged and maintained in a sterile condition. The new cap possesses an area for venting containing a plug of a fibrous filter material and an area through which a plastic spike or a sharpened hypodermic-like needle can be plunged wherein the proximal end has a flexible conduit attached thereto which has been previously attached to a source of plasma. The plasma is pumped from the source into the thermoplastic bottle. Thereafter, the bottle is subjected at the flattened neck portion thereof to compression and heating, whereby the flat portion is further compressed into touching relationship. The part above the heat sealed area containing the puncture spike or needle then can be severed as desired. The plasma filled bottle is subsequently frozen, after which it can be transported to the place for further collection. The plasma in the bottle is then thawed prior to emptying the contents therefrom.

For ease of removal of the contents, the filled bottles are positioned on a conveyor so that they can be transported to a position where a cutting device severs a portion of the bottom of the bottle thereby permitting the liquefied plasma to flow therefrom under the aegis of gravity into a central collection vessel.

DETAILED DESCRIPTION OF THE INVENTION

Figure 1:
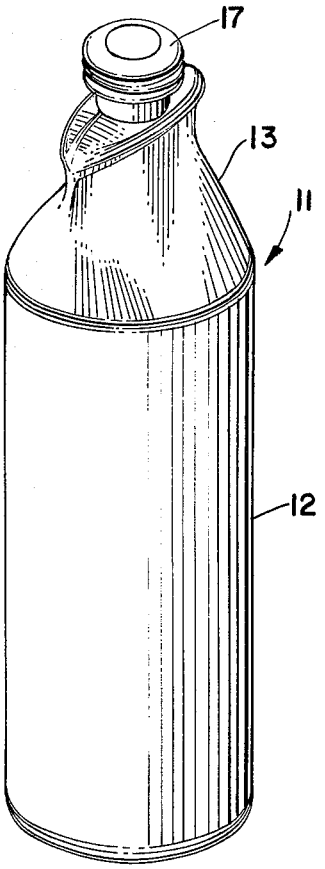
FIG. 1 is a perspective view of one embodiment of the thermoplastic blow-molded bottle of the present invention.
Figure 2:
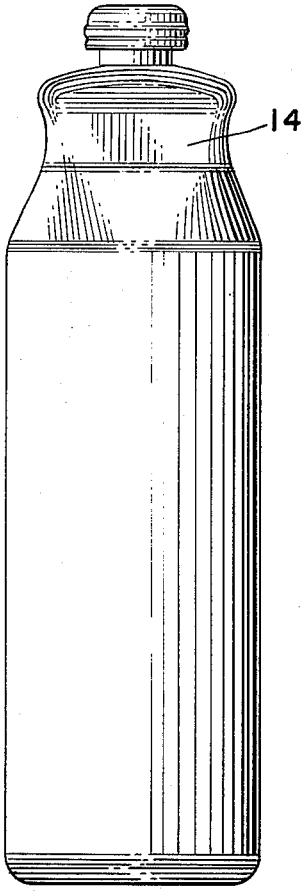
FIG. 2 is one side view of the bottle of FIG. 1.
Figure 3:
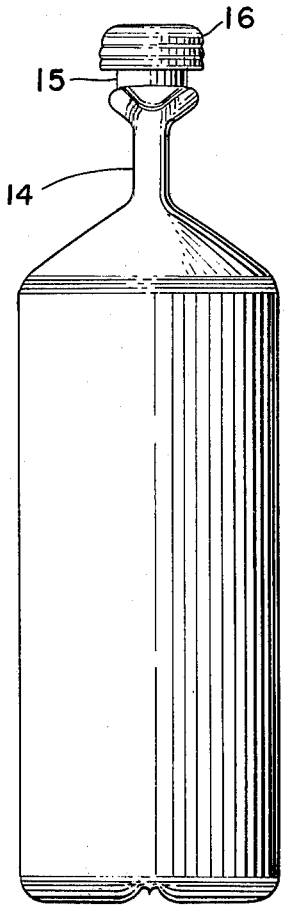
FIG. 3 is another side view of the bottle of FIG. 1.
Figure 4:
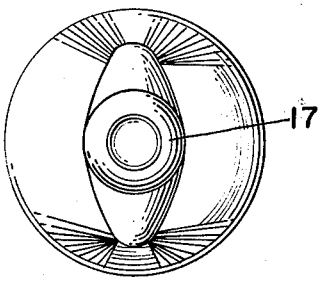
FIG. 4 is a top view of the bottle of FIG. 1.
Figure 5:
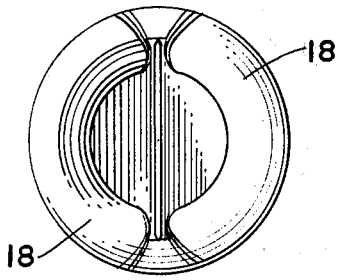
FIG. 5 is a bottom view of the bottle of FIG. 1.

The present invention relates to an ingenious method for collecting plasma and, especially, the bottle which is to be used to store the plasma during the transportation thereof from the collection site to the laboratory for utilization. With regard thereto, attention is directed to FIGS. 1–5 for further understanding the bottle of the present invention.

The bottle is shown generally by reference numeral 11. The bottle 11 has a body 12 having a cylindrical configuration. The bottle has a converging shoulder portion 13 at the upper end thereof. The shoulder portion is flattened at neck 14 to produce a constriction area of a flattened configuration. The portion above the flattened area widens and terminates in a cylindrical upper portion 15 to which a widened portion 16 is integral. The top of the bottle terminates in a pierceable membrane 17. The bottom 19 of the bottle has depending semi-annular members 18 which is somewhat dictated for construction purposes in order to obtain strength as a result of the type of mold being used.

Figure 6:
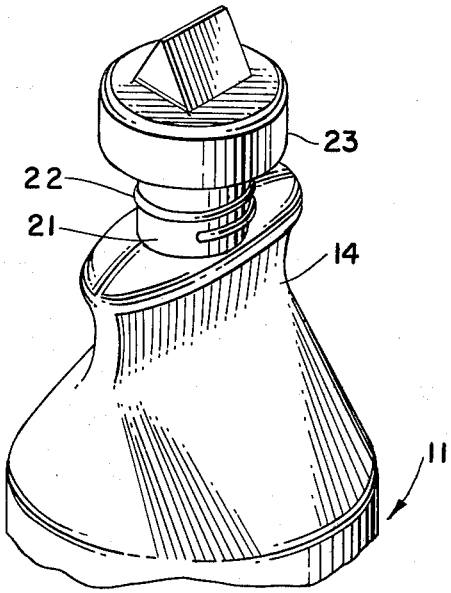
FIG. 6 is a perspective fragmentary view of another embodiment of the bottle of the present invention.
Figure 7:
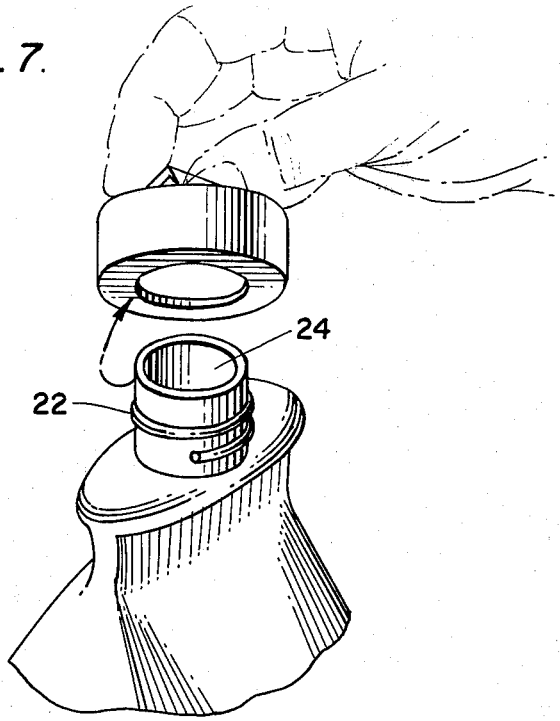
FIG. 7 is a perspective view illustrating the removal of the cap from the embodiment shown in FIG. 6.
Figure 8:
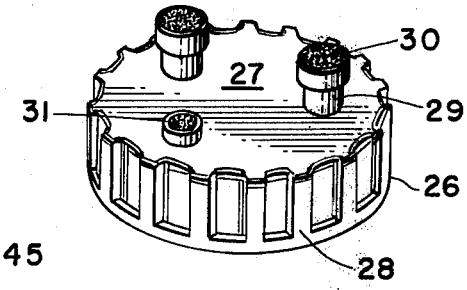
FIG. 8 is a perspective view of a screw-on cap having a suitable vent and two capped ports therein.

From FIGS. 6 and 7, it will be appreciated that the bottle in this embodiment of the present invention has a somewhat different configuration than the embodiment of FIGS. 1 to 5 above the flattened neck portion 14 where it has become wider again. Instead of having the cylindrical portion 15, the embodiment of FIGS. 6 and 7 possesses a cylindrical portion 21 having screw threads 22 thereon. Again, a widened portion is included as identified by reference numeral 23. This portion constitutes a cap which can be broken away as is seen from FIG. 7 to reveal an open mouth 24. Inasmuch as this embodiment has screw threads 22, it will be seen that a screw cap can be affixed thereto after said cap is broken away. Accordingly, attention is now directed to FIG. 8 which illustrates a screw cap 26 having a top 27 and a depending skirt 28 having a plurality of knurls thereon to facilitate gripping thereof. Not shown are the screw threads for mating with the screw threads 22 on the bottle of the embodiment shown in FIGS. 6 and 7. The screw threads are located internally with respect to skirt 28. At the top of the cap 26 there is a short tubular extension 29 which is open at one end but is capped with a plastic or rubber cap 39. After removal of cap 30, a plastic spike or metal needle can be plunged through tubular extension 29. Additionally, a vent 31 is positioned at the top 27 so that air can be expelled from the bottle as the bottle is filled through cap 30.

In order to illustrate the filling technique to be utilized in conjunction with the present invention, plasma is collected or charged into a flexible thermoplastic bag 40 which is mounted between a fixed upright wall 41 and a hinged second wall 42 of a plasma extractor 48. The hinged wall 42 is hinged at 43 and has a lever 44 so that between the fixed wall and the hinged wall the thermoplastic bag 40 containing the plasma is squeezed therebetween. The plasma is flowed through flexible conduit 45 in the direction of the thermoplastic bottle 11. Prior to the squeezing, cap 30 is removed and a plastic spike 46 is plunged through tubular extension 29. The spike can also be a metal needle of the hypodermic type so that it is sharpened with a bevel at one end in a conventional manner and the other end is affixed to the conduit 45. A radially extending flange 47 is utilized to facilitate gripping. When the conduit has been suitably connected to the bottle 11 the lever 44 is pushed upwardly, thereby squeezing hinged wall 42 against the outer surface of thermoplastic bag 40, and thus extracting out the plasma into the bottle 11. A second unit plasma collected in a thermoplastic bag 40 can be similarly extracted and transferred to bottle 11 with another such transfer set with a spike plunged through the second tubular extension 29.

Figure 11:
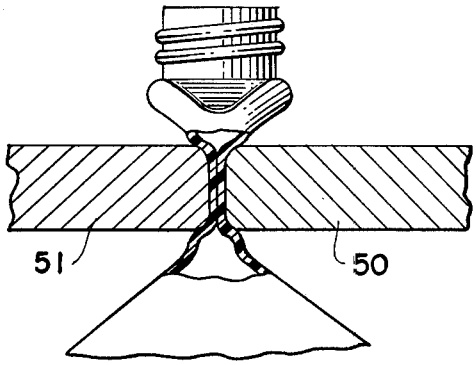
FIG. 11 is the same view as in FIG. 10 wherein means is included to compress and heat seal said neck portion.

After the bottle has been suitably filled, it is positioned in a manner so that the flattened neck portion 14 has one side thereof in abutment with heat sealing bars 50 and 51, one of which is shown as a fixed member 50 and the other as a movable member 51 at the other side thereof. The members 50 and 51 are suitably heated as by electric resistance means (not shown). The heated members soften the thermoplastic material of the flattened portion 14 of the neck so that as lateral pressure is applied to member 51 to move it in the direction shown by the arrow, that is, towards member 50, the flattened portion 14 of the neck will be further compressed and crushed. It can be readily seen from FIG. 11, that the neck has been completely collapsed so that the internal surfaces thereof are in abutment; and because they have been heated, they will now become heat sealed together.

Figure 12:
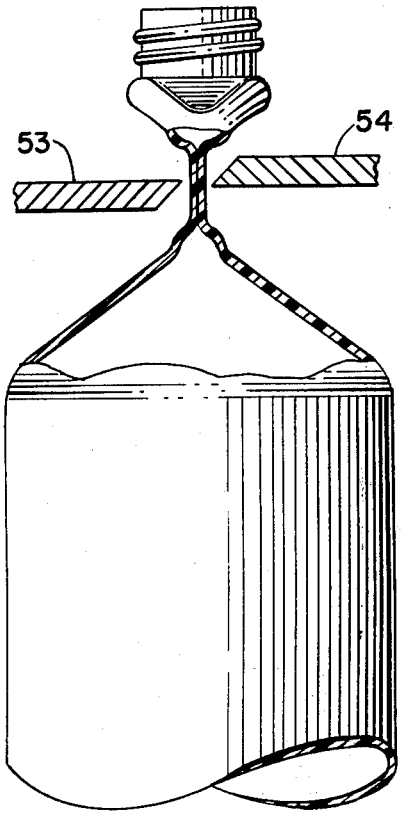
FIG. 12 is a similar view as FIGS. 10 and 11 but wherein a cutting device is employed to sever the bottle through said heat sealed and compressed neck portion.
Figure 13:
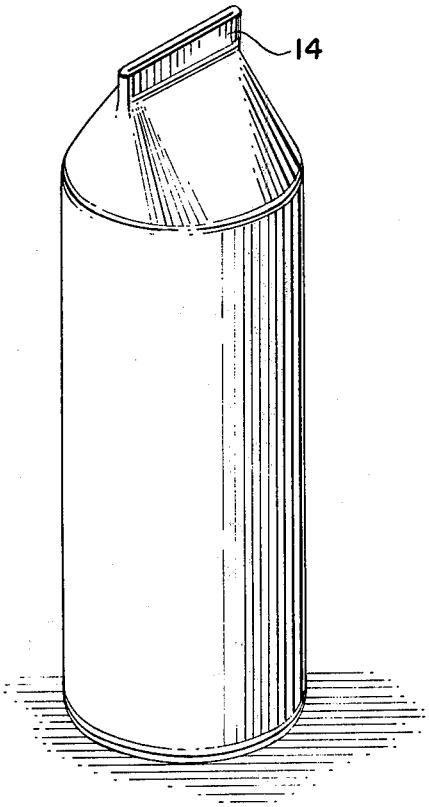
FIG. 13 is a perspective view after the severing step.

Thereafter, the bottle is severed at flattened neck portion 14 such as by shearing or cutting. This is illustrated in FIG. 12 wherein blade 53 of a cutting tool is positioned against one side of the collapsed and heat sealed neck and blade 54 of the cutting tool is at the other side thereof. By closing the blades of the cutting tool, the upper portion of the bottle is severed from the remaining main body as can be seen from FIG. 13 which is a perspective view showing the fact that the top of the bottle has been severed.

After the top has been severed as indicated heretofore, the thermoplastic bottle containing the plasma is subjected to a quick freezing step so that the plasma therein is frozen. By employing a thermoplastic bottle, the plasma does not cause an untoward expansion such as would burst a conventional glass bottle. Moreover, the bottle is preferably only partially filled, such as about one-half filled, to allow for plasma expansion. The frozen plasma is then transported to the laboratory for utilization as desired at a time remote in time from the period of collection.

Figure 14:
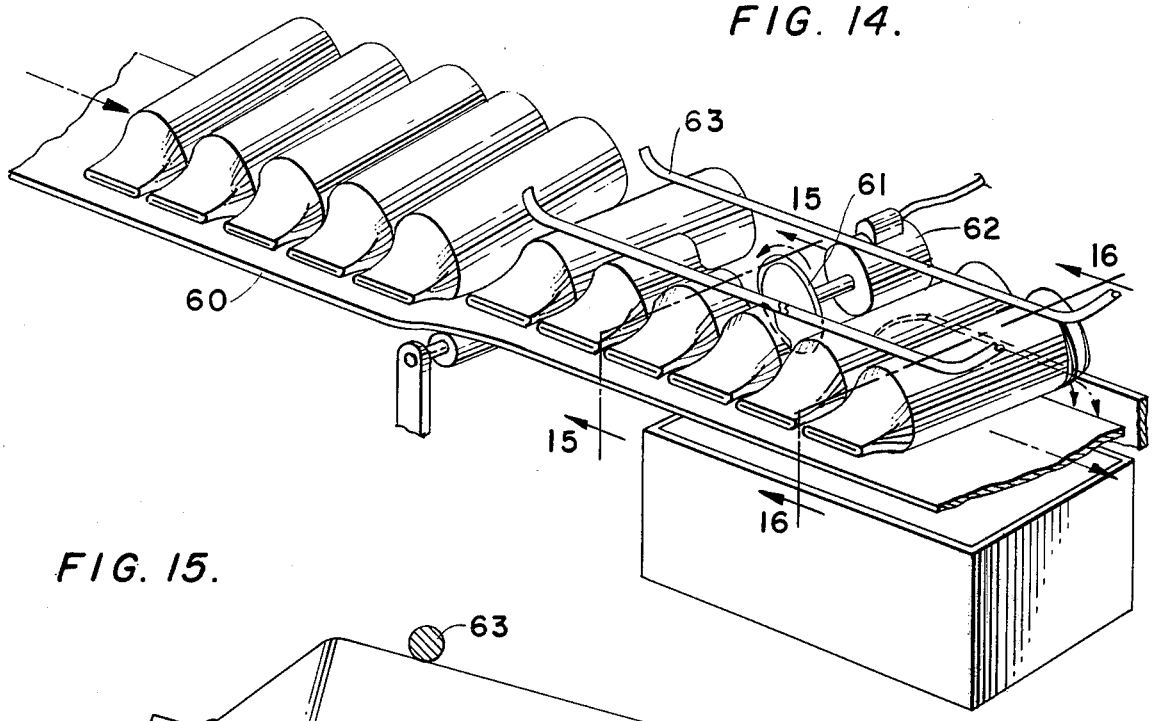
FIG. 14 is a perspective view of a conveyor system and one embodiment of a cutting means for severing through the bottom portion of the thermoplastic bottle and a collection vessel in association therewith.
Figure 15:
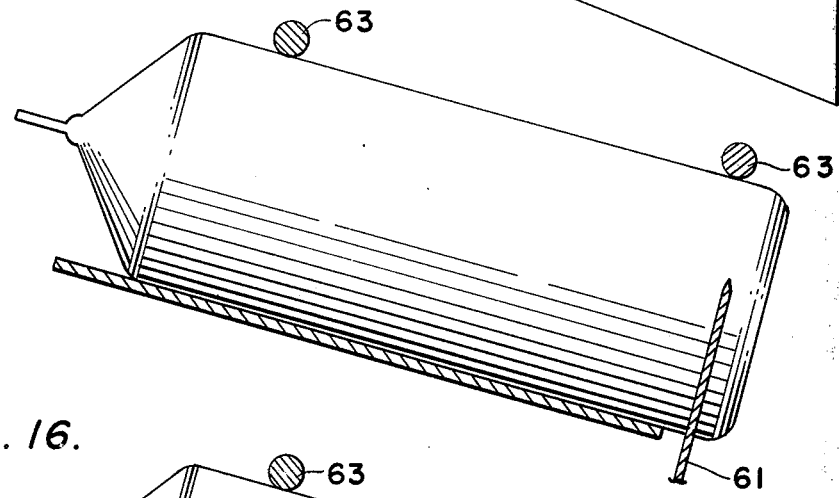
FIG. 15 is a cross-sectional view taken along line 15—15 of FIG. 14.
Figure 17:
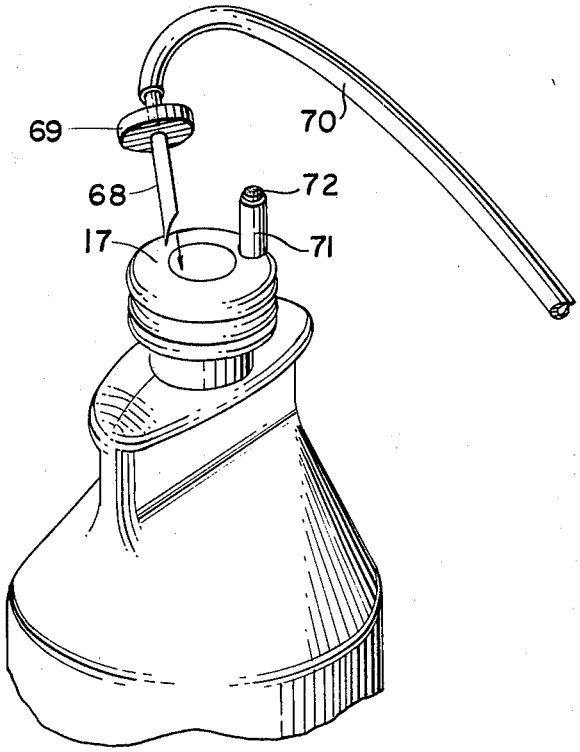
FIG. 17 is a perspective view of the use of the bottle shown in FIG. 1 wherein the plastic spike is seen to be plunged into the pierceable membrane and the spike has attached at the other end thereof a flexible conduit.

When it is desired to utilize the plasma and to remove the contents from the thermoplastic bottle, the plasma is permitted to become thawed by conventional methods and means. When it has become suitably thawed, it can be fed along with a number of other such thermoplastic bottles to a conveyor system which can be a belt conveyor system as illustrated by FIG. 14. In the embodiment shown in FIG. 14, the thermoplastic bottles containing plasma are moved in the direction of a cutting tool while the thermoplastic bottles containing the plasma are in a slightly inclined position. The belt is shown by FIG. 17 and the cutting tool is a circular device 61 which is powered by a suitable motor means 62. Hold down rods 63 are positioned so that the cutting tool 61 can penetrate the cylindrical portion of the bottle near the bottom thereof as is more fully understood from FIG. 15.

Figure 16:
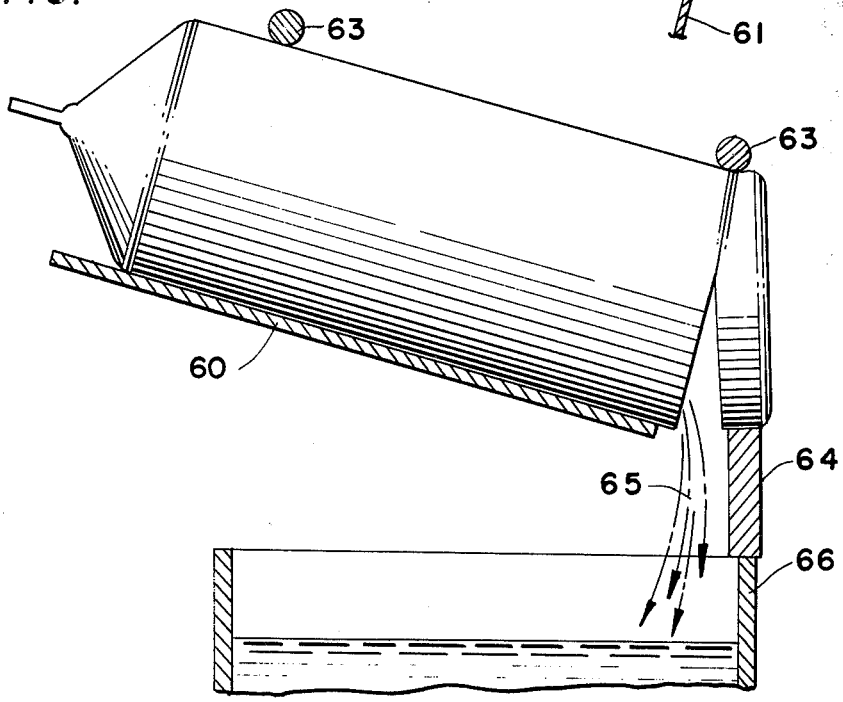

Inasmuch as the cutting tool 61 desirably is extremely thin and sharp so that none of the thermoplastic material is severed therefrom as shavings, the slit under ordinary conditions will be very thin so that it is desirable to open up the cut to more efficaciously permit the removal of the plasma. Accordingly, as the thermoplastic bottles are transported after the cutting stage, a cam surface 64 is provided which is designed to move the bottom portion that has been severed into a more horizontal condition while the hold down means 63 maintain the bottle in the inclined position taken in conjuction with the moving belt 60. By opening up the bottle in the manner shown in FIG. 16, the plasma 65 is permitted to drop out of the bottle into a collection vessel 66 from which the plasma is commingled with a plurality of plasma collected from many thermoplastic bottles of the same type with which the present invention is concerned.

Figure 21:
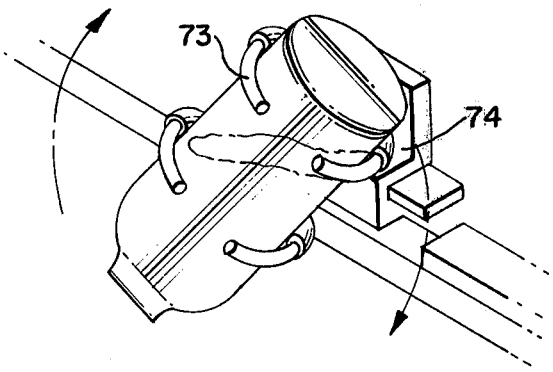
FIG. 21 is a perspective view of the severed bottle being inverted to dump plasma into a collection vessel.
Figure 22:
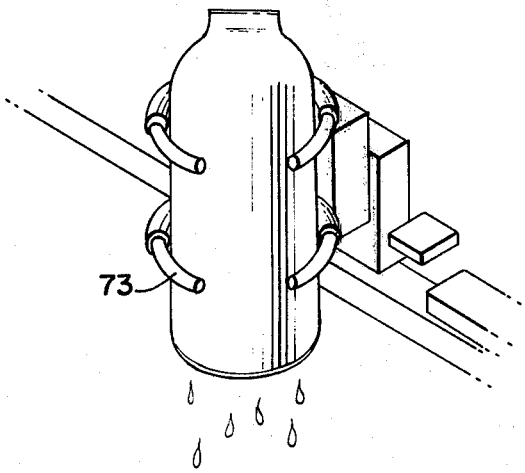
FIG. 22 is a perspective view of the severed bottle of FIG. 21 held inverted until all the plasma has been dumped.

Another embodiment for cutting the thermoplastic bottle and removing the contents is illustrated in FIGS. 19 to 22. In this embodiment, the bottle is held vertically upside down in fingers 73 of holder 74. The bottle is then fed through band saw 75 whereby the bottom (which appears at the top in the upside down position) is cut off. The bottle is then carried to a position above a collection vessel and inverted in the direction of the arrow as shown in FIG. 21, whereby the entire plasma contents are dumped into the collection vessel as shown in FIG. 22.

Figure 9:
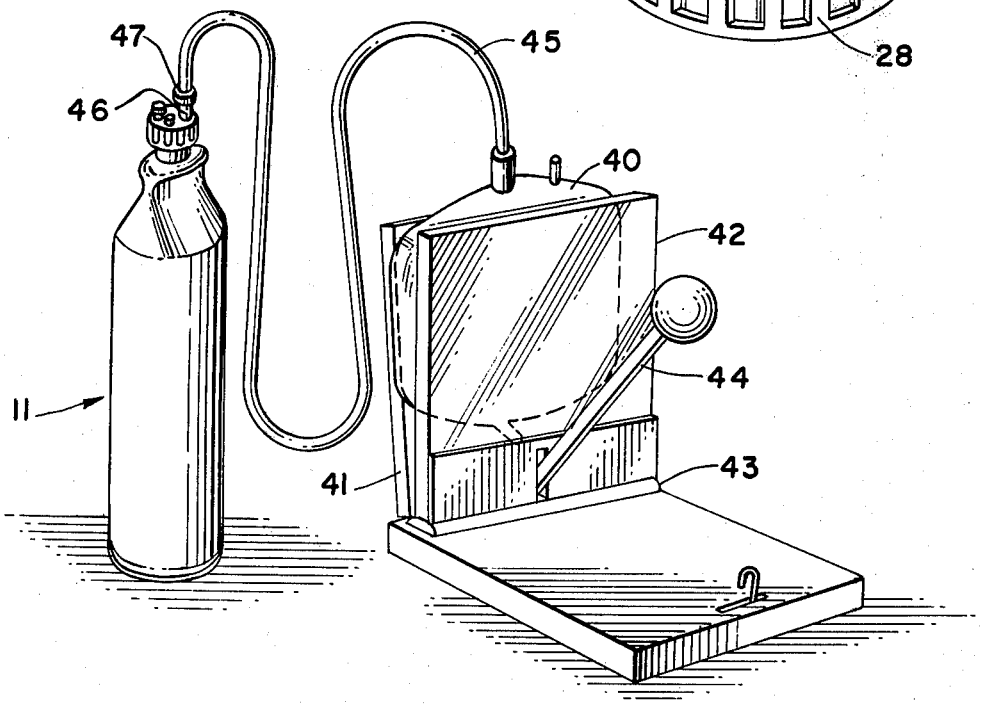
FIG. 9 is a perpective view of the bottle of the present invention having a screw cap thereon and a conduit having at one end a plastic spike thrusted therethrough and wherein the conduit at the other end is secured to a source of plasma, said source being in a press for expressing the plasma therefrom.
Figure 10:
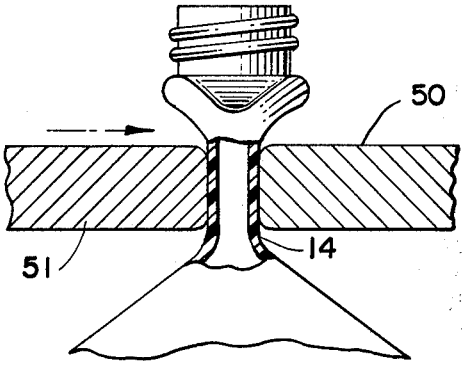
FIG. 10 is a cross-sectional view of the neck portion of the bottle of the present invention.

As was stated in the above, another embodiment of the present invention concerns a bottle of the thermoplastic type constructed in the same manner as above. Accordingly, attention is directed to FIG. 17 to show the use of the bottle as a receptacle for plasma. FIG. 17 shows a bottle having a configuration of the type shown by FIGS. 1–5. The pierceable membrane 17 is seen to about to be plunged therethrough by means of a plastic spike 68 which can also be, as stated herein before, a metal hypodermic needle. The plastic spike 68 has an outwardly radiating flange of an annular configuration 69 so that it can be easily gripped. The proximal end of the spike has a conduit 70 attached thereto whose end terminates at a source of plasma such as shown in FIG. 9. The arrow indicates the fact that the spike 68 is about to be plunged into the pierceable membrane 17. Additionally, the pierceable membrane already has been punctured with a short sterile tube 71 having a sterile fibrous plug 72 therein. The tube 71 acts as a venting means so that the air captured in the thermoplastic bottle can be vented to the atmosphere as the plasma is pumped therein.

Figure 18:
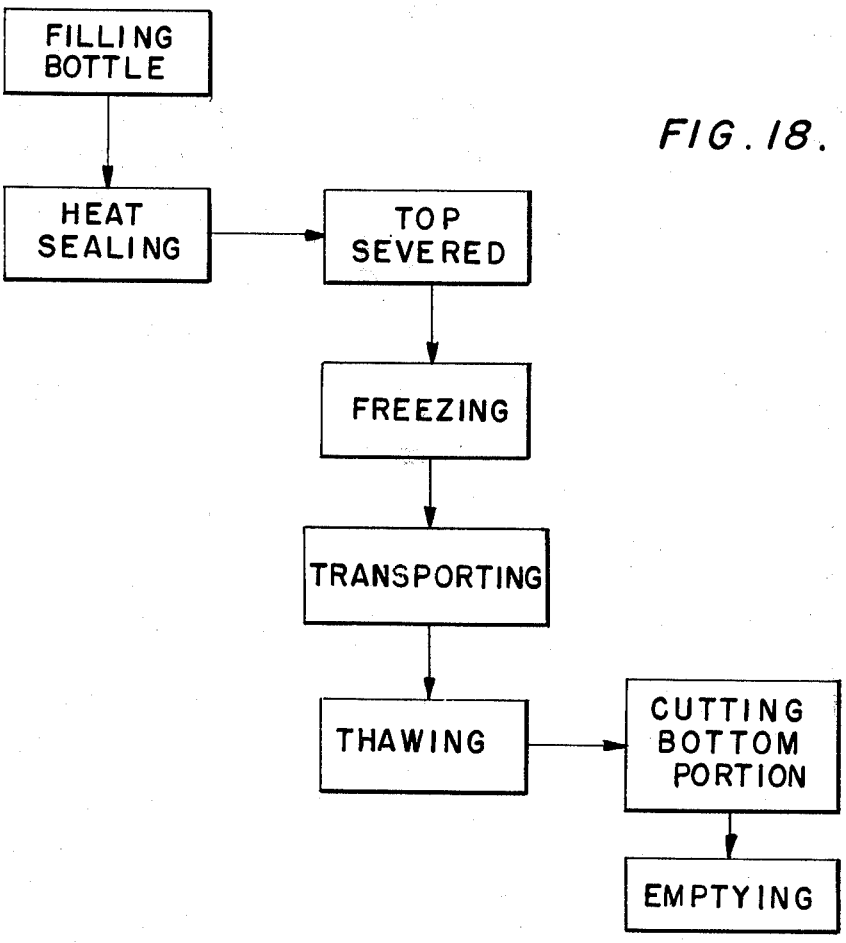
FIG. 18 is a flow diagram showing the steps of the method of the present invention.
Figure 19:
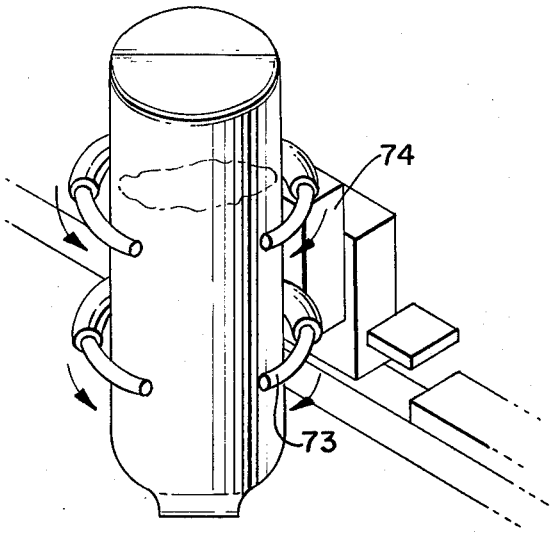
FIG. 19 is a perspective view of a bottle holding means and a thermoplastic bottle held in an upside down position.
Figure 20:
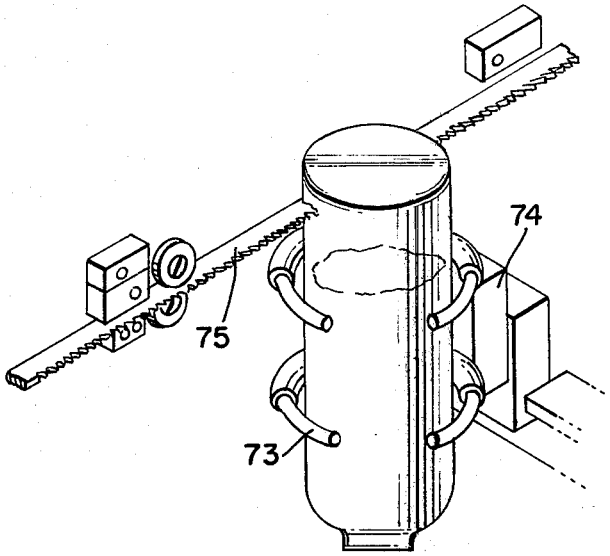
FIG. 20 is a perspective view of another embodiment of a cutting means for severing through the bottom of the thermoplastic bottle held in the bottle holder of FIG. 19.

In the foregoing, considerable attention has been directed to the embodiments of the thermoplastic bottle which include the concept of a method for collecting and storing plasma. With special reference to the method of the present invention as herein disclosed, attention is specifically called to FIG. 18 for a diagrammatic flow diagram to show the manner in which the thermoplastic bottle is used in the collection of plasma. It will be seen that as an initial step after the thermoplastic bottle has been attached to a source of plasma, the thermoplastic bottle is filled with plasma. As a next step, the neck portion which has been previously flattened is sealed. The portion of the bottle above the heat sealed area is then severed by suitable means as has been heretofore discussed. Thereafter, the contents in the thermoplastic bottle are heretofore discussed. Thereafter, the contents in the thermoplastic bottle are subjected to freezing temperatures in order to freeze the plasma. After freezing, the thermoplastic bottle containing the plasma can be transported in the frozen state or can be stored as desired. Prior to emptying of the thermoplastic bottle, the plasma is stored in a suitable and conventional manner. As a further step in the method of carrying out the present invention, the bottom portion of the thermoplastic bottle can be cut in order to provide an opening from which the plasma can be obtained which is then collected in a suitable vessel from which the plasma can be removed for fractionating purposes as desired.

It will be appreciated that the present invention is not limited to the specific examples set forth above and that various other examples and modifications of the foregoing examples will be apparent to the person skilled in the art after reading the foregoing specification without departing from the spirit and scope of the invention. All such further examples and modifications thereof are inclined within the scope of the invention as defined in the appended claims.

What is claimed is:

1. A method of sterile collecting blood plasma for use in blood fractionation procedures comprising providing ingress through the top of a thermoplastic bottle, with a sharpened cannula at the distal end of a tubular means, said thermoplastic bottle having been sterile blow-molded and hermetically sealed without a port and with a flattened constricted neck portion, the proximal end of said means being connected to a blood plasma donor set, introducing a quantity of blood plasma from said blood plasma donor set through said tubular means into said thermoplastic bottle, further flattening said flattened constricted neck portion whereby the inner surfaces of the oppositely disposed flattened constricted neck portion sealingly abut, simultaneously applying heat to said flattened neck portion whereby the said abutting surfaces adhere to one another, and thereafter freezing and thawing said collected blood plasma and transferring into larger containers by cutting open said thermoplastic bottle substantially near the bottom portion and pouring said blood plasma therefrom.

2. The method of claim 1 including the steps of breaking off the uppermost portion of the constricted neck to provide an opening to the inside of the bottle, affixing a cap to said opening, and then obtaining egress through a port in said cap by means of a sharpened cannula attached to said tubular means which is plunged through said port.

3. The method of claim 2 including the step after the said inner surfaces have been adhered together under the aegis of heat of severing that portion of the neck above the said surfaces that have been adhered together.

* * * * *

UNITED STATES PATENT AND TRADEMARK OFFICE

CERTIFICATE OF CORRECTION

PATENT NO. : 3,939,623

DATED : February 24, 1976

INVENTOR(S) : Dennis F. Shine and Gunther W. Torau

It is certified that error appears in the above-identified patent and that said Letters Patent are hereby corrected as shown below:

Column 6, line 55, delete "inclined" and insert therefor --included--.

Claim 1, line 65, after "said" insert --tubular--.

Signed and Sealed this

Fourteenth Day of June 1977

[SEAL]

*Attest:*

RUTH C. MASON
*Attesting Officer*

C. MARSHALL DANN
*Commissioner of Patents and Trademarks*